US011627775B1

(12) United States Patent
Devine

(10) Patent No.: US 11,627,775 B1
(45) Date of Patent: Apr. 18, 2023

(54) RAIN GUARD FOR HEADWEAR

(71) Applicant: Joseph Devine, Milton, NY (US)

(72) Inventor: Joseph Devine, Milton, NY (US)

( * ) Notice: Subject to any disclaimer, the term of this patent is extended or adjusted under 35 U.S.C. 154(b) by 119 days.

(21) Appl. No.: 17/029,803

(22) Filed: Sep. 23, 2020

(51) Int. Cl.

| | |
|---|---|
| ***A42B 3/22*** | (2006.01) |
| ***A42B 1/0183*** | (2021.01) |
| ***A42B 1/018*** | (2021.01) |
| ***A42B 3/04*** | (2006.01) |
| ***A42B 1/18*** | (2006.01) |

(52) U.S. Cl.
CPC ..... *A42B 3/227* (2013.01); *A42B 1/0183* (2021.01); *A42B 1/18* (2013.01); *A42B 3/0406* (2013.01); *Y10S 2/05* (2013.01)

(58) Field of Classification Search
CPC ..... A42B 3/227; A42B 1/18; A42B 3/0406; A42B 1/0183; A42B 1/002; Y10S 2/05; A42C 1/06
See application file for complete search history.

(56) References Cited

U.S. PATENT DOCUMENTS

| | | | | |
|---|---|---|---|---|
| 4,210,972 A | | 7/1980 | BAclit | |
| 4,726,074 A | | 2/1988 | Baclit et al. | |
| 5,177,810 A | | 1/1993 | Minton et al. | |
| 5,208,916 A | * | 5/1993 | Kelman | G02C 7/10 2/10 |
| 5,544,361 A | * | 8/1996 | Fine | A42B 1/0181 2/454 |
| 6,151,719 A | * | 11/2000 | Poole | A42B 3/20 2/DIG. 5 |
| 6,173,447 B1 | * | 1/2001 | Arnold | A42B 1/0184 2/10 |
| 7,178,173 B2 | * | 2/2007 | Kronenberger | A42B 1/002 2/209.13 |
| D685,138 S | | 6/2013 | Leedom | |
| 8,973,166 B1 | * | 3/2015 | Engle | A42B 1/0183 2/209.12 |
| 2002/0042941 A1 | * | 4/2002 | Grundy | A42C 5/00 40/329 |
| 2005/0172380 A1 | * | 8/2005 | Turkington | A42B 1/248 2/175.4 |
| 2016/0050990 A1 | * | 2/2016 | Hayes | A41D 13/1184 2/9 |
| 2016/0316841 A1 | * | 11/2016 | Melnyk | A42B 1/002 |
| 2019/0390397 A1 | * | 12/2019 | Wynn | D06F 95/008 |

FOREIGN PATENT DOCUMENTS

| | | | | |
|---|---|---|---|---|
| CA | 2928477 A1 | * | 10/2016 | A42B 1/002 |

OTHER PUBLICATIONS

Half Motorcycle Helmet With Detachable Visor. Product Listing [online]. RS Helmets, [retrieved on Jul. 23, 2019], Retrieved form the Internet: <URL: https://www.rshelmets.com/Half_Motorcyle_Helmet_With_Visor_PU_Leather.html?jclid=CjwKCAjw4NrpBRBsEiwAUcLcDKxHUIgf6K_K809EfE4aHG-SNo2KlgPgzg93yVirf41EnaaYkE1s7hoCPfwQAvD_BwE>.

* cited by examiner

*Primary Examiner* — Katherine M Moran
*Assistant Examiner* — Erick I Lopez
(74) *Attorney, Agent, or Firm* — Cramer Patent & Design, PLLC; Aaron R. Cramer

(57) ABSTRACT

A rain guard for headwear is configured to removably attach to a leading edge of a brim for the headwear. The rain guard creates a channel for collected water on the brim of the headwear to be diverted to either side of the headwear as opposed to directly in front of a wearer's line of vision.

1 Claim, 5 Drawing Sheets

RAIN GUARD FOR HEADWEAR

RELATED APPLICATIONS

None.

FIELD OF THE INVENTION

The presently disclosed subject matter is directed to a rain guard and more specifically to a rain guard for an article of headwear.

BACKGROUND OF THE INVENTION

The sport of baseball has remained among the most popular in the recent history of our country. The pure exhilaration of stepping onto a field with your teammates with only one team coming out a winner not only on the basis of physical strength but skill and ball handling as well is something that many people cannot resist. Over the years baseball helmets for the hitter and base runners have become common safety equipment and have undoubtedly saved many lives.

However, one unfortunate side effect of their use is the fact that rainwater is prone to running off of the top of the helmet and off of the center of the brim when the batter is in a "head down" batting position. As baseball is often played in light rain and drizzle, the vision obstruction can lead to missed hits and ultimately affect the outcome of the game. Accordingly, there exists a need for a means by which rainwater from batting helmet brims can be redirected to avoid the problem as described above. The development of the rain guard for headwear fulfills this need.

SUMMARY OF THE INVENTION

The principles of the present invention provide for a helmet rain guard device which comprises a first end, a second end, a center, a flat top which allows for precipitation to run off towards an upper surface of a brim of a helmet, a curved bottom which comprises a helmet gripping portion that wraps underneath the brim of the helmet to help provide a waterproof seal around the brim of the helmet, and an outward facing surface which has a raised body to elevate the flat top above the brim of the helmet. The flat top and an overhanging portion may be extending inwardly from the outward facing surface towards the center of the helmet and the brim. The flat top and the overhanging portion may extend inwardly while a water collection channel may be created below the overhanging portion and above the brim of the helmet.

The water collection channel may extend beneath the flat top all the way from the left end to the right end. The elevation may trap precipitation that lands on the brim and then may direct said precipitation towards the left end of the helmet rain guard device or the right end of the helmet rain guard device. The elevation may trap precipitation that lands on the brim and then may direct said precipitation towards the left end of the helmet rain guard device and the right end of the helmet rain guard device.

The raised body may provide clearance between the overhanging portion and the brim of the helmet. The overhanging portion may extend over the brim by the flat top of the helmet with an upward angle, thereby creating a funnel effect from the left end to the right end that may allow the precipitation to be drawn away from the outward facing surface towards the inner surface area of the brim. The overhanging portion may extend over the brim by the flat top of the helmet with a decline, thereby creating a funnel effect from the left end to the right end that may allow the precipitation to be drawn away from the outward facing surface towards the inner surface area of the brim.

The outward facing surface may include a raised body that extends from the flat top down to the curved bottom. The helmet rain guard device may be coupled to the outer edge of the brim of the helmet. The helmet rain guard device may be used with a sports-related helmet. The sports-related helmet may be a football, hockey, or baseball helmet. The helmet rain guard device may be applied to the helmet with manual force and then frictionally may be retained in place about the brim of said helmet. The helmet rain guard device may be constructed from a rubber material that allows for minimal expansion of a receiving groove as the brim of the helmet may be placed within said receiving groove. The helmet rain guard device may be constructed from a non-rigid plastic that may allow for minimal expansion of a receiving groove as the brim of the helmet may be placed within the receiving groove.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
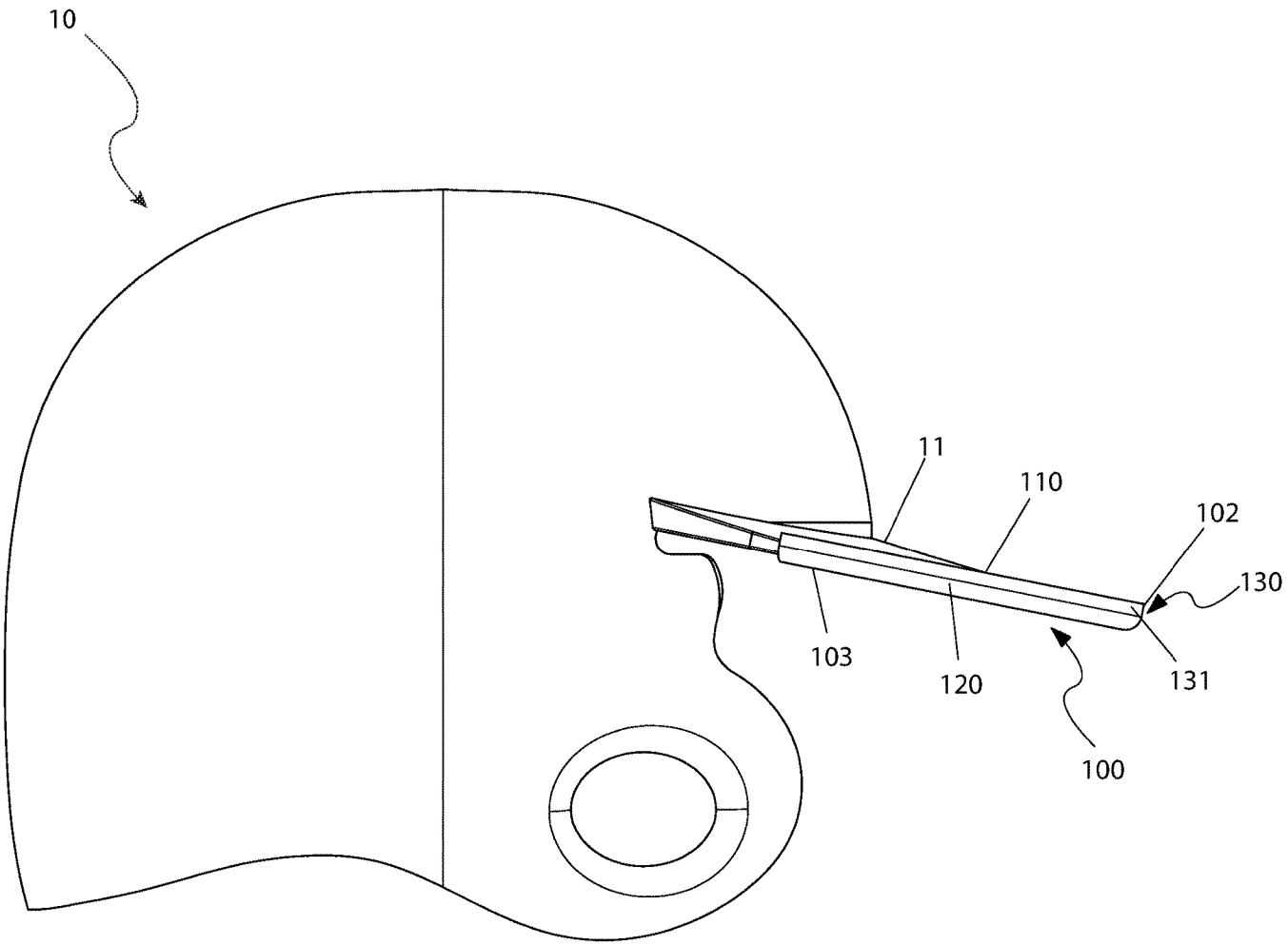
FIG. 1 is a side perspective view of the helmet rain guard device, according to the preferred embodiment of the present invention.

10 helmet
11 brim
100 helmet rain guard device
101 left end
102 center
103 right end
110 flat top
111 overhanging portion
112 water collection channel
120 curved bottom
121 helmet gripping portion
130 outward facing surface
131 raised body
140 receiving groove

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a side perspective view of the helmet rain guard device 100, according to the preferred embodiment of the present invention is disclosed. The helmet rain guard device 100 may include a right end 103, a center 102, a flat top 110, a curved bottom 120, and an outward facing surface 130 having a raised body 131. The flat top 110 may be configured to allow precipitation to run off towards the upper surface of a brim 11 of a helmet 10. The helmet rain guard device 100 may be particularly suited for use with a sports-related helmet 10 but may also be used in other applications as well. The helmet rain guard device 100 may be applied to the helmet 10 with simple manual force and then frictionally retained in place about the brim 11 of said helmet 10 without the need of any other bonding agents or supplies.

Figure 2:
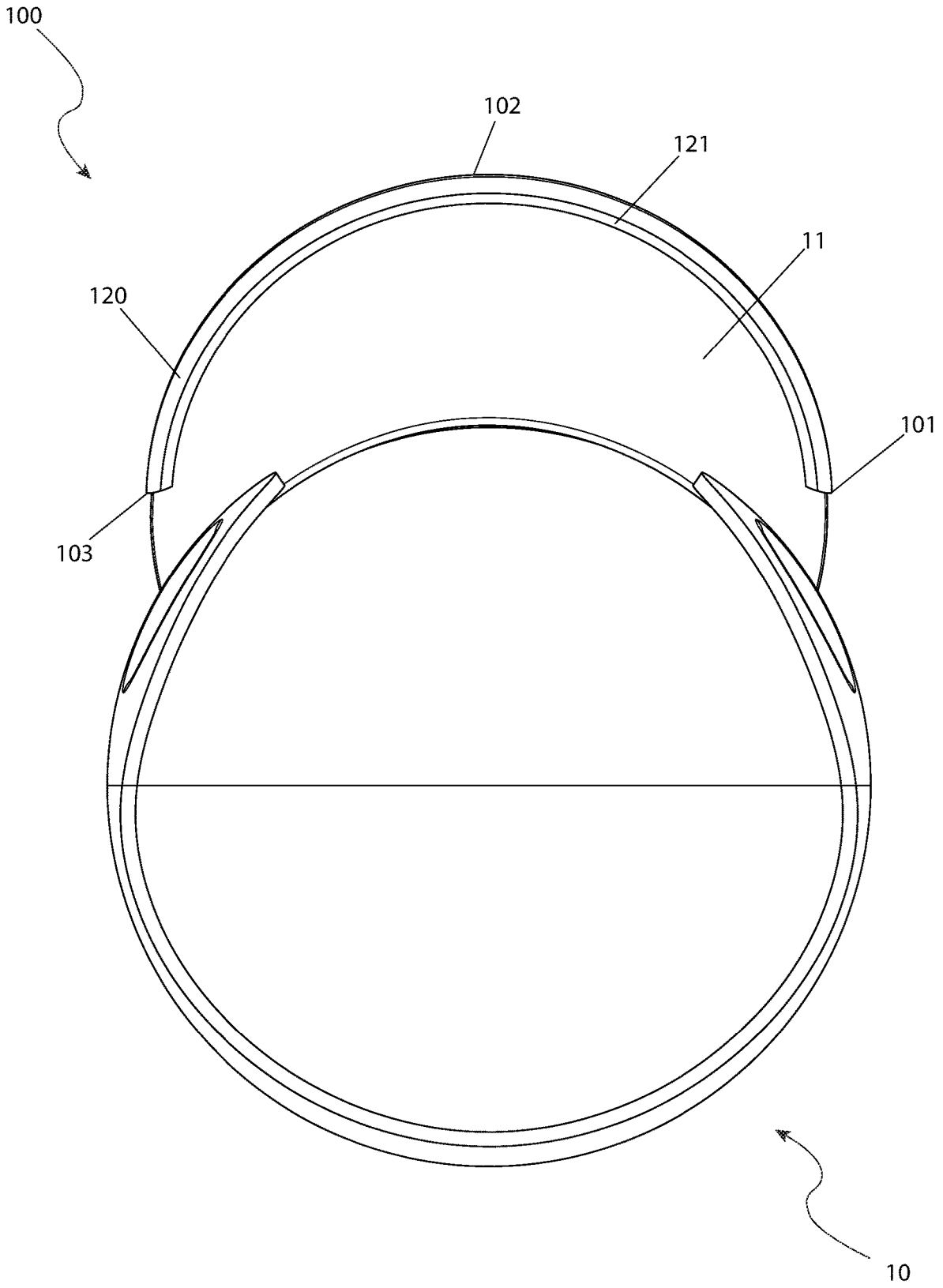
FIG. 2 is a bottom perspective view of the helmet rain guard device, according to the preferred embodiment of the present invention.

Referring next to FIG. 2, a bottom perspective view of the helmet rain guard device 100, according to the preferred embodiment of the present invention is depicted. This view shows the bottom view of a helmet 10 with the helmet rain guard device 100 coupled to the brim 11. The helmet rain guard device 100 may include a left end 101, a center 102, and a right end 103. The device 100 may also include a curved bottom 120 having a helmet gripping portion 121 that wraps underneath the brim 11 of the helmet 10 to help provide a waterproof seal around the brim 11 of the helmet 10. Further, the helmet rain guard device 100 may include an outward facing surface 130. The outward facing surface 130 may feature a raised body 131 portion configured to elevate the flat top 110 (not shown) above the brim 11 of the helmet 10. This elevation may be suited for trapping precipitation that lands on the brim 11 and then directing said precipitation towards the left end 101 and/or the right end 103.

Figure 3:
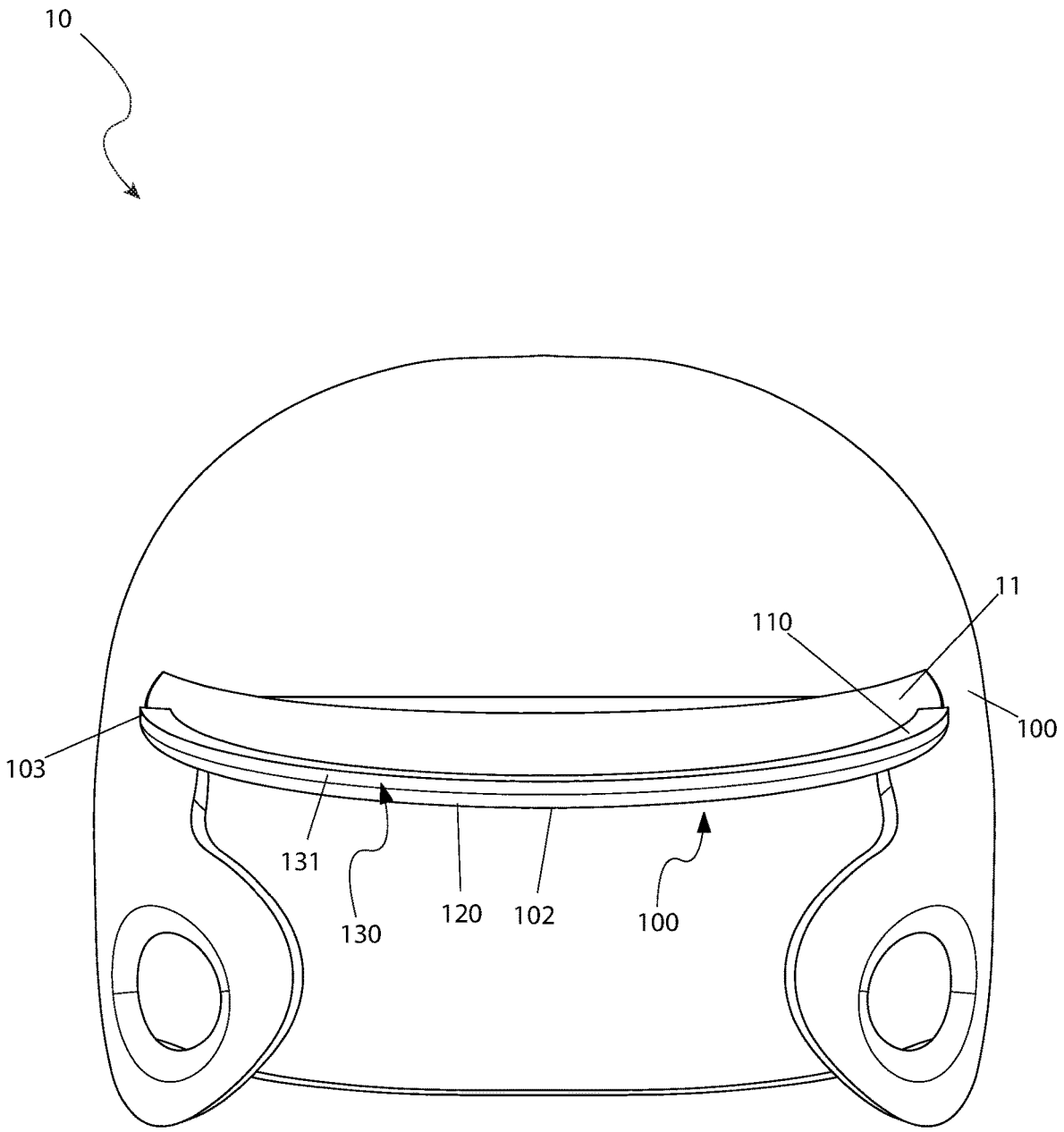
FIG. 3 is a front perspective view of the helmet rain guard device, according to the preferred embodiment of the present invention.

Referring now to FIG. 3, a front perspective view of the helmet rain guard device 100 for a helmet 10 with a brim 11, according to the preferred embodiment of the present invention. As before, the helmet rain guard device 100 may include a left end 101, a center 102, and a right end 103. The device 100 may also include a flat top 110, an overhanging portion 111, a curved bottom 120, and raised body 131 extending from the left end 101 to the right end 103. The raised body 131 may provide clearance between the overhanging portion 111 and the brim 11 of the helmet 10. The overhanging portion 111 may be configured by the flat top 110 extending over the brim 11 of the helmet 10 with a slight angle or decline, thereby creating a funnel effect from the left end 101 to the right end 103 that allows any precipitation (rain specifically) to be drawn away from the outward facing surface 130 towards the inner surface area of the brim 11.

Figure 4:
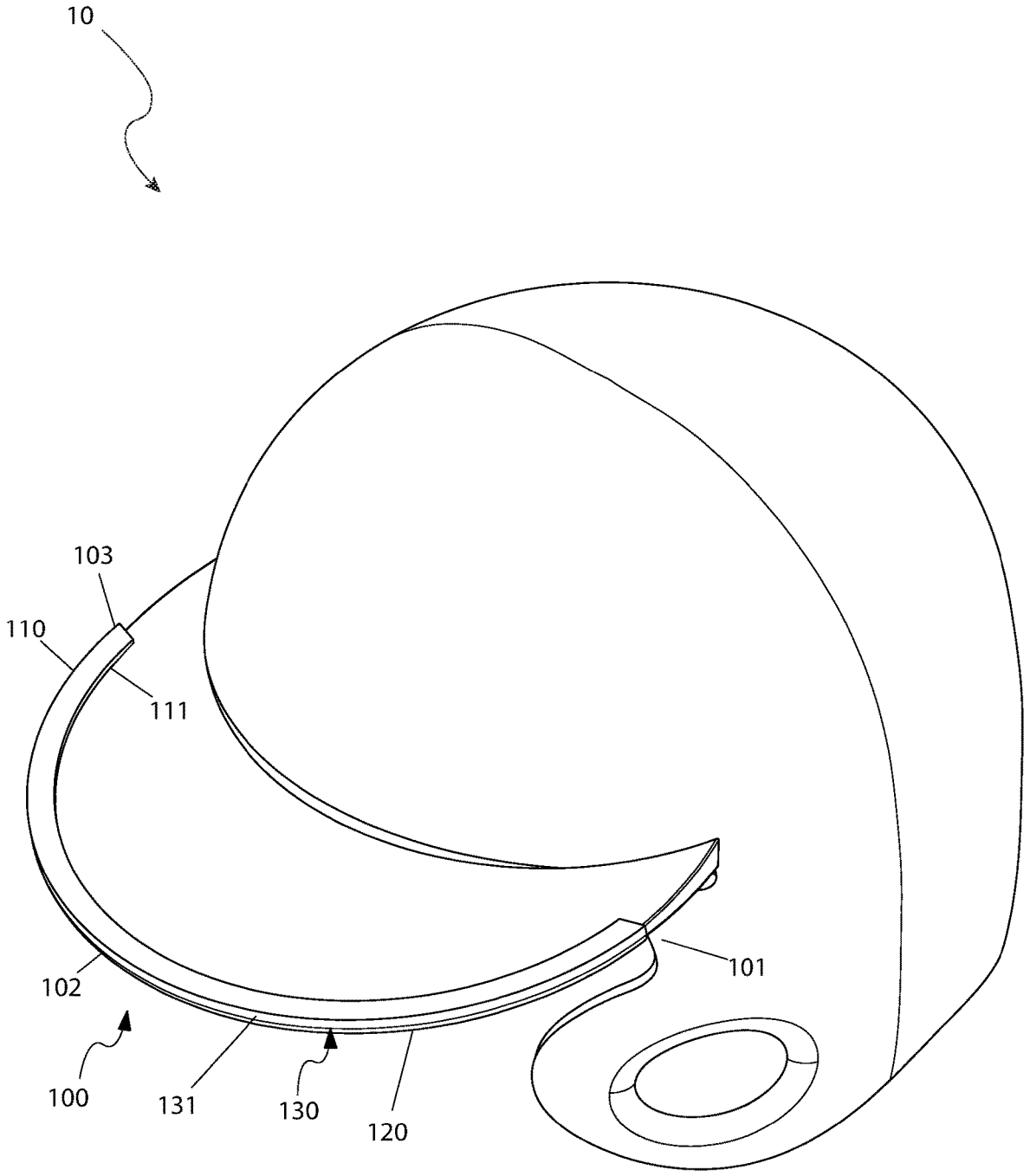
FIG. 4 is a top perspective view of the helmet rain guard device, according to the preferred embodiment of the present invention; and, FIG. 5 is a cross-sectional view of the helmet rain guard device, according to the preferred embodiment of the present invention.

Referring next to FIG. 4, a top perspective view of the helmet rain guard device 100, according to the preferred embodiment of the present invention is disclosed. This view illustrates the helmet rain guard device 100 coupled to the outer edge of the brim 11 of a helmet 10. As before, the helmet rain guard device 100 may include a left end 101, a center 102, and a right end 103. This view also shows a water collection channel 112 as configured by the space created between the flat top 110, the overhanging portion 111, and the brim 11 of the helmet 10. The outward facing surface 130 may include a raised body 131 configured to elevate the flat top 110 above the brim 11 of the helmet 10. Underneath the brim 11, the device 100 includes a curved bottom 120. The curved bottom 120 may be configured to draw precipitation away from the user's field of vision.

Figure 5:
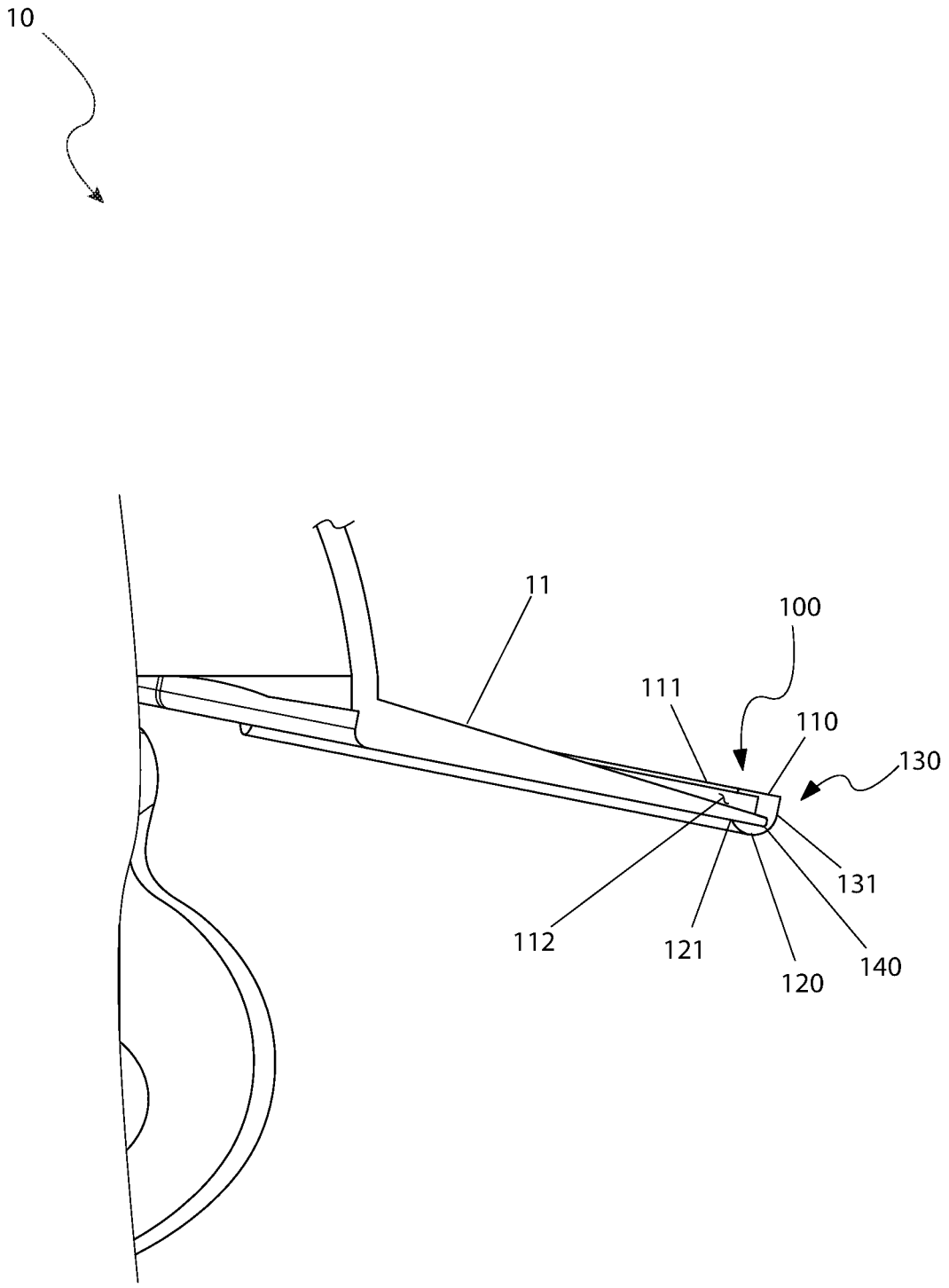

Referring lastly to FIG. 5, there is shown a cross-sectional view of the helmet rain guard device 100, according to the preferred embodiment of the present invention. As illustrated, the helmet rain guard device 100 includes a flat top 110 and an overhanging portion 111 extending inwardly from the outward facing surface 130 towards the center of the helmet 10 and brim 11. As the flat top 110 and overhanging portion 111 extend inwardly, a water collection channel 112 is created below the overhanging portion 111 and above the brim 11 of the helmet 10. This water collection channel 112 extends beneath the flat top 110 all the way from the left end 101 to the right end 103 (not shown here). The outward facing surface 130 includes a raised body 131 that extends from the flat top 110 down to the curved bottom 120. The helmet rain guard device 100 may be frictionally coupled to the brim 11 of a helmet by means of a receiving groove 140 within the raised body 131. The device 100 may be constructed from a rubber material or non-rigid plastic that allows for minimal expansion of the receiving groove 140 as the brim 11 of the helmet 10 is placed within said receiving groove 140. The device 100 may be removable and easily interchangeable to allow for quick transfers between multiple helmets 10 or other desired surfaces.

2. Operation of the Preferred Embodiment

The preferred embodiment of the present invention can be utilized by the common user in a simple and effortless manner with little or no training. It is envisioned that the helmet rain guard device 100 would be constructed in general accordance with FIG. 1 through FIG. 5. The user would procure the helmet rain guard device 100 through normal procurement channels, paying particular attention to the relevant specifications required for the helmet desired. While the preferred embodiment may be especially suited for use on a rigid sports-related helmet 10, it is certainly possible that this invention may be equally suited for selective use on a cap, hat, or non-sports helmet 10 such as a motorcycle helmet or other such head protecting device.

After procurement and prior to utilization, the helmet rain guard device 100 would be installed upon the brim 11 of the helmet 10. During utilization of the helmet rain guard device 100, a user would not need to do anything specific for the device 100 to perform its intended function. The device 100 may be configured to collect precipitation (rain) automatically beneath the overhanging portion 111 and draw the resulting precipitation towards the left end 101 and right end

103 without any further assistance from the user, thereby helping to reduce water drip zones and pooled water from the user's field of vision.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A helmet rain guard device configured to couple to an outer edge of a brim of a helmet, the rain guard device consisting of:

a curved body having a front, a rear, a first end, a second end, and a center portion between the first end and the second end;

a flat top surface configured to allow precipitation to run off towards an upper surface of the brim of the helmet, wherein the flat top surface extends from the front to the rear of the curved body and terminating at an overhanging portion;

the front having an outward facing surface, the outward facing surface having a raised body, wherein the raised body extends from the flat top surface downwardly to a curved bottom, the curved bottom having a helmet gripping portion configured to wrap underneath the brim of the helmet and configured to provide a waterproof seal between the curved bottom and a lower surface of the brim;

the raised body configured to elevate the flat top surface above the brim of the helmet such that the flat top surface and the overhanging portion extend rearwardly from the outward facing surface and are configured to extend towards a center of the helmet and over the brim of the helmet, wherein the raised body is configured to provide a clearance between the overhanging portion and the brim of the helmet to create a water collection channel in a space below the overhanging portion and beneath the flat top surface;

the water collection channel extends from the first end to the second end and is configured to trap precipitation that lands on the brim and direct said precipitation towards the first end and the second end of curved body; and wherein the helmet rain guard device is adapted to be used with a sports-related helmet selected from the group consisting of a football helmet, a hockey helmet, or a baseball helmet.

* * * * *